US005355937A

United States Patent [19]

Mueller et al.

[11] Patent Number: 5,355,937

[45] Date of Patent: Oct. 18, 1994

[54] METHOD AND APPARATUS FOR THE MANUFACTURE OF A METAL STRIP WITH NEAR NET SHAPE

[75] Inventors: Hilmar R. Mueller, Bellenberg; Georg Kehse, Laupheim, both of Fed. Rep. of Germany

[73] Assignee: Wieland-Werke AG, Ulm, Fed. Rep. of Germany

[21] Appl. No.: 950,902

[22] Filed: Sep. 24, 1992

[30] Foreign Application Priority Data

Sep. 27, 1991 [DE] Fed. Rep. of Germany ..... 4132189
Jun. 5, 1992 [DE] Fed. Rep. of Germany ..... 4218587

[51] Int. Cl.[5] ..... B22D 11/06; B22D 37/00

[52] U.S. Cl. ..... 164/479; 164/453; 164/429

[58] Field of Search ..... 164/451, 452, 453, 479, 164/154, 155, 449, 429, 437

[56] References Cited

U.S. PATENT DOCUMENTS

| | | | |
|---|---|---|---|
| 993,904 | 5/1911 | Strange | 164/429 |
| 3,791,437 | 2/1974 | Yamada | 164/133 |
| 3,842,894 | 10/1974 | Southworth | 164/449 |
| 4,449,568 | 5/1984 | Narasimham | 164/449 |

FOREIGN PATENT DOCUMENTS

| | | | |
|---|---|---|---|
| 5823550 | 2/1983 | Japan | 164/452 |
| 195849 | 4/1984 | Japan | 164/449 |
| 5997755 | 6/1984 | Japan | 164/337 |
| 59169650 | 9/1984 | Japan | 164/150 |
| 63215341 | 9/1988 | Japan | 164/429 |
| 63215342 | 9/1988 | Japan | 164/429 |

*Primary Examiner*—P. Austin Bradley
*Assistant Examiner*—Rex E. Pelto
*Attorney, Agent, or Firm*—Flynn, Thiel, Boutell & Tanis

[57] ABSTRACT

A method and an apparatus for the continuous manufacture of a metal strip (1) with near net shape. The metal melt (6) is fed from a melt distributor (5) through a casting nozzle (15) onto a rotating, cooled conveyor belt (2) and solidified. In the operating condition, the melt level is controlled in the melt distributor (5) as a function of the desired strip thickness d of the metal strip (1). In the melt distributor (5) there is initially adjusted a fill level (A), which corresponds at a maximum with the conveyor belt plane (E). Such a fill level (B) then is adjusted such that the melt (6) completely displaces the air from the area (11, 14) in front of the casting nozzle (15) and from the casting nozzle (15). In the operating condition, the fill level (C) is controlled some millimeters above the level (D) of the liquid metal on the conveyor belt (E) so that the melt (6) flows out of the casting nozzle (15) according to the pipette principle.

19 Claims, 7 Drawing Sheets

METHOD AND APPARATUS FOR THE MANUFACTURE OF A METAL STRIP WITH NEAR NET SHAPE

FIELD OF THE INVENTION

The invention relates to a method for the continuous manufacture of a metal strip with approximate final dimensions.

BACKGROUND OF THE INVENTION

In methods of the mentioned type, the main problem lies in the metal melt being supplied as evenly as possible onto the rotating conveyor belt, namely the supply is supposed to take place as turbulence-free as possible, and the metal melt is supposed to have approximately the same speed as the conveyor belt.

A method of the mentioned type (for example according to DE-PS 3 810 302) is carried out with a melt distributor designed as a double chamber with a pouring-in chamber and a pouring-out chamber, with the pouring-out chamber being connected to an underpressure chamber. The melt level can be controlled by the gas pressure in the pouring-out chamber and thus the amount of outflow of the metal exiting from the casting nozzle.

Generally, only a very low supply pressure corresponding with a metallostatic level of some millimeters is generally only needed for the occurring casting speeds. Due to the needed lining thicknesses of the melt distributor, this level is clearly exceeded already through structural necessities. With the help of the underpressure in DE-PS 3 810 302, it is possible to lower the effective metallostatic level below the distributor wall thickness; however, in the case of zinc-containing copper alloys, underpressure above the melt level in the distributor must be avoided since in these alloys the zinc would be more strongly evaporated and the vacuum pumps would become dirty.

The basic purpose of the invention is therefore to control the speed of outflow of the metal melt in such a manner that, by avoiding an underpressure produced by the vacuum pumps, the metal flow is as laminar as possible and the speed of the metal melt and of the conveyor belt approximately correspond to one another.

SUMMARY OF THE INVENTION

The purpose is attained according to the invention by a fill level (A) being initially adjusted in the melt distributor, which level corresponds at a maximum with the plane (E) of the conveyor belt, by such a fill level (B) being adjusted for casting start-up that the melt completely displaces the air from the area in front of the casting nozzle and from the casting nozzle, and that in the operating condition, the fill level (C) is controlled some millimeters above the level (D) of the liquid metal on the conveyor belt (E) so that the melt flows out of the casting nozzle according to the pipette principle.

According to another attainment of the purpose, according to which the casting phase can be designed more favorably, it is provided that in the melt distributor, consisting of a pouring-in chamber, a gastight pressure chamber and a pouring-out chamber, there is initially adjusted a fill level (A) corresponding at a maximum with the plane (E) of the conveyor belt, that for casting start-up, with the inlet of the casting nozzle connected after a pipette being closed with respect to the metal melt, the pipette having a valve or the like, is at least partially filled with the valve being open (fill level B'), that subsequently after the partial opening of the inlet of the casting nozzle and construction of a melt pool on the conveyer belt through a continuous, further opening of the inlet of the casting nozzle with the valve closed, an underpressure is built up in the pipette and the air in the casting nozzle is displaced upwardly, and that in the operating condition the fill level (C) is controlled some millimeters above the level (D) of the liquid metal on the conveyer belt (E) so that the melt flows out of the casting nozzle according to the pipette principle.

With the inventive use of the pipette principle to effect flow of melt from the nozzle, it is possible, without utilizing a vacuum, to adjust any type of metallostatic level up to the value of zero independent from the lining thickness of the distributor.

The fill level (B) or (B') during casting start-up is adjusted preferably by means of excess pressure of an inert gas. It is thereby advisable that also the fill level (C) is controlled in the operating condition by means of excess pressure.

According to an inventive alternative, the fill level (B) is adjusted during casting by a continuous melt supply into the melt distributor. Independent of the type of casting start-up, the fill level (C) is, according to a particular embodiment of the invention, controlled in the operating condition under a continuous melt supply by means of a conventional control of the casting level. Such a control of the casting level according to the eddy current principle is for example described in DE-PS 2 951 097.

The advantage of this solution compared with the pressure gas lead is that after the casting, an almost constant level must be controlled while in the case of the pressure gas load the gas pressure must be adjusted up to approximately 0.5 bar to 0.5 millibar.

According to a particular embodiment of the invention, the fill level (C) is adjusted in the operating condition approximately 2–15 mm above the level (D) of the liquid metal, with the metallostatic level to be controlled depending in particular from the casting speed.

According to special embodiments of the second attainment of the invention, the underpressure is built up in the pipette either at a constant pressure in the pressure chamber or through ventilation of the pressure chamber. It is advisable in particular for controlling the method that the underpressure built up in the pipette is monitored.

In order to avoid that the pipette and casting nozzle freeze during the casting start-up phase, these parts are preferably preheated prior to the casting start-up. The casting nozzle is thereby heated up advantageously by means of a burner introduced into the vented pipette, while for heating up the pipette, with the inlet of the casting nozzle being closed with respect to the metal melt, the pipette, with the valve being open, is filled once or several times with metal melt by varying the gas pressure in the pressure chamber.

The invention relates furthermore to several embodiments of a casting apparatus for carrying out the method of the invention.

The design of the casting apparatus depends on the type of casting and whether both casting and also controlling of the fill level in the operating condition is carried out by means of excess pressure or whether only the casting is carried out by means of excess pressure and the subsequent adjustment is carried out with the help of a casting level control or whether excess pressure is not at all utilized.

A first embodiment of the casting apparatus has the following elements: a melt distributor terminating in a casting nozzle above a rotating, cooled conveyor belt and a strip-thickness measuring device connected to a controllable gas source.

It is characterized by the melt distributor being designed as a triple chamber with a pouring-in chamber, a gastight pressure chamber and a pouring-out chamber, to which is connected a pipette emptying into the casting nozzle, and by the controllable gas source being connected to the pressure chamber. A steplike refilling is possible with this casting apparatus.

In order to suppress undesired bath-level variations in the pouring-in chamber, the cross-sectional surface $F_E$ may not be designed too small. The relationship $F_E$/-cross-sectional surface $F_D$ of the pressure chamber is preferably: $F_E/F_D$=1:5 to 1:16.

To carry out a continuous refilling, the casting apparatus has according to a further preferred embodiment the following elements: a melt distributor terminating in a casting nozzle above a rotating, cooled conveyor belt, a strip-thickness measuring device and a controllable gas source.

It is characterized by the melt distributor being designed as a triple chamber with a pouring-in chamber, a gastight pressure chamber and a pouring-out chamber, to which is connected a pipette emptying into the casting nozzle, by the controllable gas source being connected to the pressure chamber, by a tundish arranged above the melt distributor being provided, the immersion pipe of which tundish extends into the pouring-in chamber, and by the strip-thickness measuring device being connected to a casting-level control, the probe of which is arranged above the melt level in the pouring-in chamber.

A further modification of the invention has the following elements: a melt distributor, which terminates in a casting nozzle above a rotating, cooled conveyor belt, a strip-thickness measuring device and a controllable gas source. It is characterized by a pipette emptying into the casting nozzle being connected to the melt distributor through a pouring-out chamber, by the melt distributor being closed off gastight by a tundish arranged above, the immersion tube of which tundish extends into the melt distributor, by the controllable gas source being Connected to the formed pressure chamber, and by the strip-thickness measuring device being connected to a casting-level control, the probe of which is arranged above the melt level. In order to enable a complete emptying of the melt distributor at the end of the casting operation, the pipette is preferably arranged at the lower end of the melt distributor.

A further embodiment, in which excess pressure is not at all utilized, has the following elements: a melt distributor which terminates in a casting nozzle above a rotating, cooled conveyor belt, and a strip-thickness measuring device. It is characterized by the melt distributor being designed as a double chamber with a pouring-in chamber and a pouring-out chamber, to which is connected a pipette emptying into the casting nozzle, by a tundish arranged above the melt distributor, the immersion tube of which tundish extends into the pouring-in chamber, and by the strip-thickness measuring device being connected to a casting-level control, the probe of which is arranged above the melt level in the pouring-in chamber.

Since the melt level between the fill level (B) during casting start-up and the fill level (C) in the operating condition changes, the probe of the casting-level control must be designed preferably elevationally adjustable.

The melt is, during casting start-up in all embodiments of the present casting apparatus, moved through the pouring-out area with approximately 2 to 4 times the flow rate compared with the stationary casting process in order to completely displace the air initially existing in this area. This operation is supported by the geometric design of the pouring-out area. The cross-sectional surfaces $F_A$ of the pouring-out chamber, $F_S$ of the pipette and $F_G$ of the casting nozzle are preferably chosen with the following relationship: $F_A$:$F_S$:$F_G$=8:4:1 to 2:1, 5:1. It can thereby be advantageous to continuously reduce the cross sections in pouring-out direction. This, however, can also be done in steps for reasons of easier manufacturing.

The invention relates furthermore to a casting apparatus for carrying out the method of the invention with a changed casting start-up phase, which method has the following elements: a melt distributor ending in a casting nozzle above a rotating, cooled conveyor belt and a strip-thickness measuring device, which is connected to a controllable gas source. This casting apparatus is characterized by the melt distributor being designed as a triple chamber with a pouring-in chamber, a gastight pressure chamber and a pouring-out chamber, to which a pipette emptying into the casting nozzle is connected, by the pipette being designed as a forehearth, into the bottom of which is inserted the casting nozzle, by the casting nozzle being closed off by one or several plugs, by the pipette having a valve or the like, and by the controllable gas source being connected to the pressure chamber.

In order to make the pipette accessible for cleaning purposes, it is advantageous when same has a removable lid. Said lid can be designed as follows according to the invention: The plug or the plugs are guided gastight in said lid; the lid has an opening and a guideway for a burner, and in it there can be the valve, with burner and valve being in particular able to be arranged exchangeably at the same area.

The described invention can be carried out not only in connection with a cooled conveyor belt, but also in connection with other moving cooling surfaces, thus for example with a cooled chain or a cooling roller.

BRIEF DESCRIPTION OF THE DRAWINGS

The invention will be discussed in greater detail in connection with the following exemplary embodiments. In the drawings.

DETAILED DESCRIPTION

Figure 1:
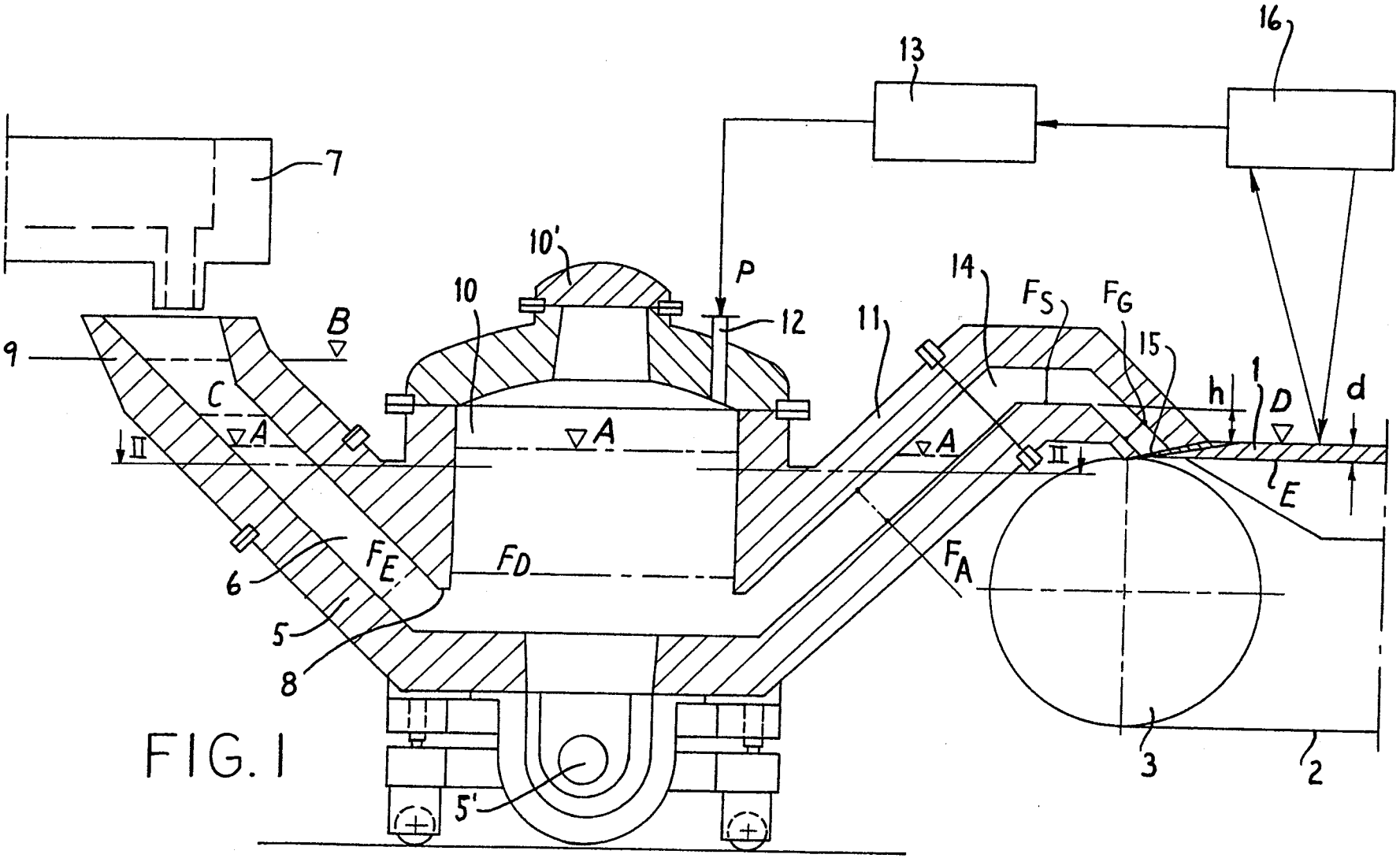
FIG. 1 is a vertical cross-sectional view of a first embodiment of the casting apparatus of the invention.

FIG. 1 illustrates a casting apparatus for the continuous manufacture of metal strip 1 with near net shape consisting of a cooled conveyor belt 2 rotating over spaced driving rollers 3 (only one of which is illustrated in FIG. 1), and a melt distributor 5 for metal melt 6 in the form of an induction-heated channel-type furnace (with an induction coil 5'). The melt distributor 5 has a pouring-in chamber 9 (cross-sectional surface $F_E$), a pressure chamber 10 (cross-sectional surface $F_D$) and a pouring-out chamber 11. The pressure chamber 10 is closed off gastight with a lid 10'. A gas connection 12 is provided in the lid 10', which gas connection is connected to a controllable gas source 13. A pipette 14 is connected to the pouring-out chamber 11, which pipette terminates in a casting nozzle 15 above the plane E of the conveyor belt. The pouring-out chamber 11 has a circular cross section (cross-sectional surface $F_A$), the pipette 14 (cross-sectional surface $F_S$) and the casting nozzle 15 (cross-sectional surface $F_G$) each have a rectangular cross section.

For casting start-up the apparatus is filled with metal melt 6 through the pouring-in chamber 9 from a (schematically illustrated) tundish 7. The fill level identified with the letter A, which fill level corresponds in the present case with the plane E of the conveyor belt, may thereby not be exceeded. After reaching the right casting temperature, the pressure chamber 10 is easily loaded with inert gas through the gas connection 12. This raises the melt 6 both in the pouring-in chamber 9 and also in the pouring-out chamber 11. The fill level identified with the letter B must be reached as quickly as possible in order to reach a safe filling of the pipette 14 and of the casting nozzle 15. The metallostatic supply pressure (difference of level between the fill level B in the pouring-in chamber 9 and the inner upper edge of the pipette 14) is preferably adjusted between 60 and 200 mm.

For quickly filling the pouring-out area (here pouring-out chamber 11 and pipette 14), this area is filled already prior to the start of casting by means of gas pressure until just before the pipette 14 runs over. The final filling is done by a pressure surge (the following details are not illustrated). For technical control reasons, a gas-offtake main with a sufficient volume is for this purpose filled to a predetermined pressure with an inert gas. A connection between the pressure chamber 10 and the gas-offtake main is now created through a large-dimension pipeline and a quickly switching magnetic valve. The casting start-up pressure is preferably built up in 3–10 s. Immediately after a metal flow is recognized at the outlet of the casting nozzle 15 and the casting nozzle outlet immerses completely into a "fluid pool," the pressure in the pressure chamber 10 is again reduced to a precalculated value in approximately 3–10 s by opening a discharge valve so that the fill level C in the pouring-in chamber 9 is adjusted some millimeter above the level D of the liquid metal. Only then does a switching over to the fine control take place, which fine control adjusts the desired product thickness d through the controllable gas source 13 in response to the strip-thickness measuring device 16. Based on the now-active pipette principle, the outflow speed is reduced since the active pressure is determined only by the metallostatic level difference between the fill level C in the pouring-in chamber 9 and the level D of the liquid metal. This difference can be adjusted as small as desired, independent of the structurally caused drop height h in the casting nozzle 15.

A steplike refilling is provided with this apparatus, namely no later than when the melt level in the pressure chamber 10 has reached the bottom edge identified by the reference numeral 8.

Figure 3:
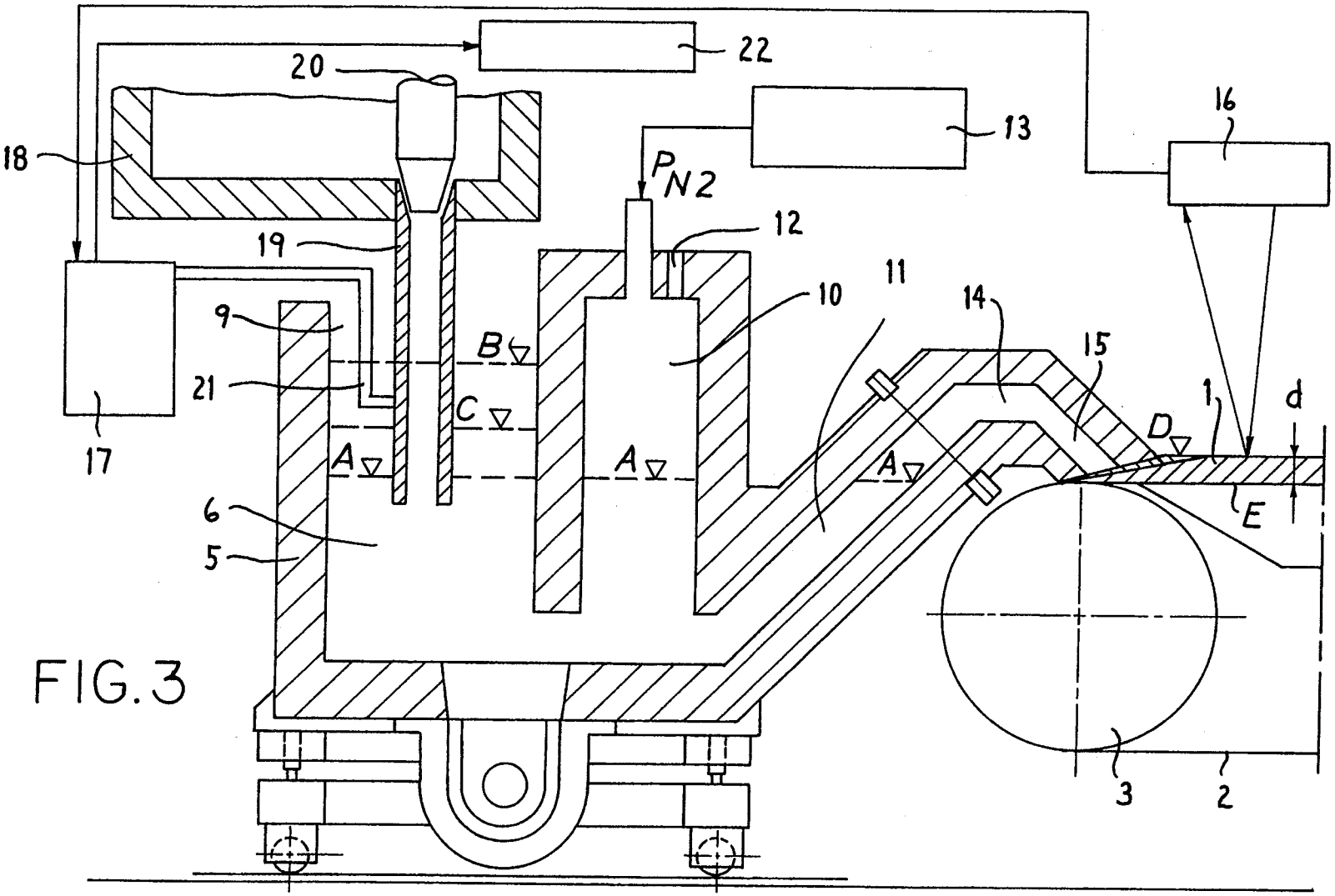
FIG. 3 shows a second embodiment of the casting apparatus of the invention.

Whereas a continuous refilling is possible with the modification of FIG. 3. The casting start-up phase is also conducted by means of excess pressure. However, the fill level C in the operating condition is controlled by means of a conventional casting level control 17. A tundish 18 is provided for this purpose above the melt distributor 5, the immersion pipe 19 of which tundish extends into the pouring-in chamber 9. The tundish 18 can be closed off with a plug 20 in the usual manner. The height of the fill level is determined by a probe 21 and is maintained at the predetermined value by the casting-level control 17. The strip-thickness measuring device 16 delivers It is also possible to adjust with this casting apparatus any desired effective metallostatic levels, with reference to the level D of the liquid metal.

Figure 4:
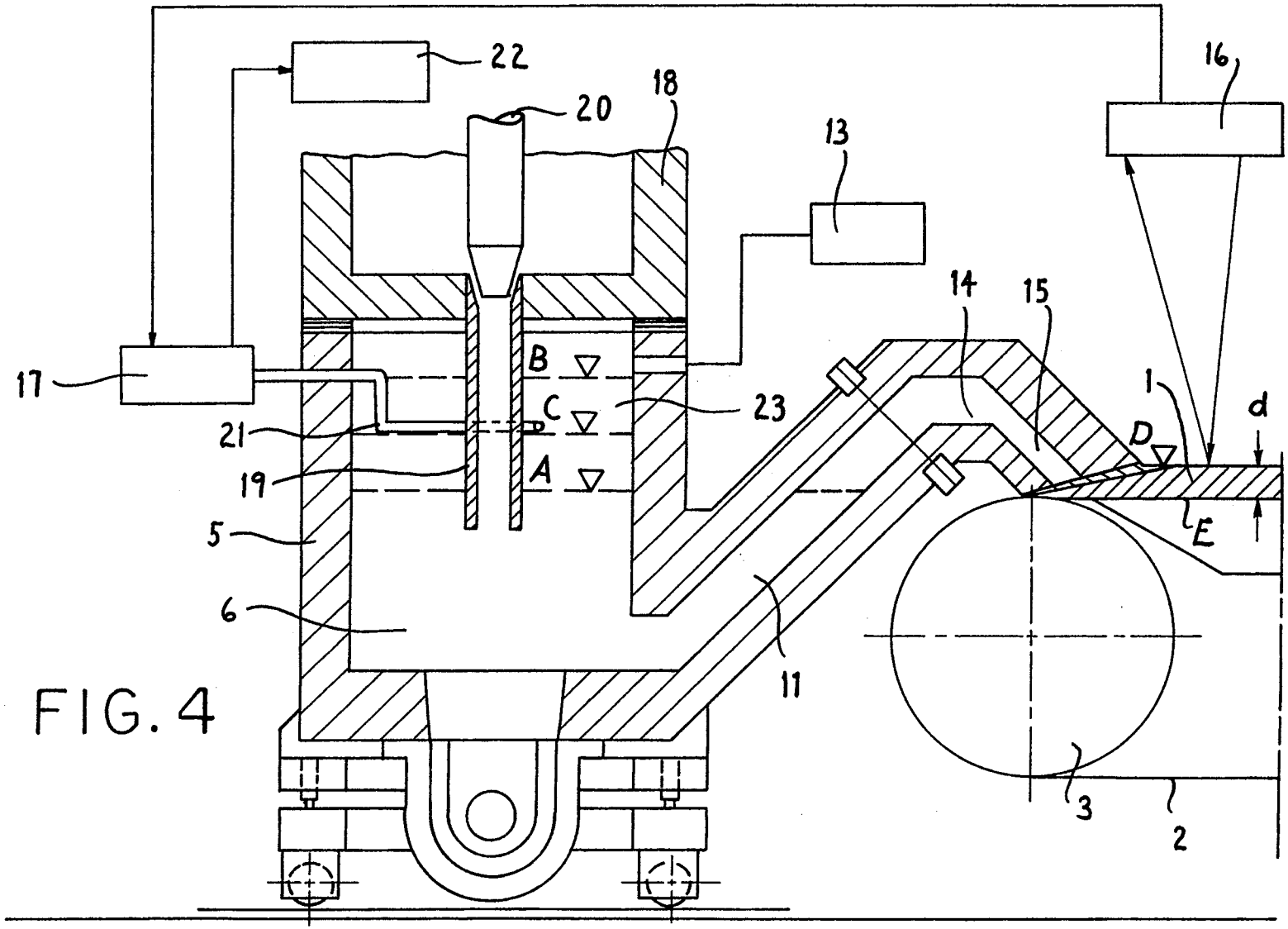
FIG. 4 shows a third embodiment of the casting apparatus of the invention.

The melt distributor 5 is in the modification according to FIG. 4 closed off gastight by a tundish 18 with an immersion tube 19. The casting start-up is again conducted by means of excess pressure by a controllable gas source 13 acting onto the so-formed pressure chamber 23. The fill level C is controlled in the operating condition by means of a casting-level control 17 in the manner described in FIG. 3. Since the pouring-out chamber 11 is connected to the lower end of the melt distributor 5, the melt distributor 5 can be emptied easily at the end of the casting operation by means of excess pressure.

Figure 5:
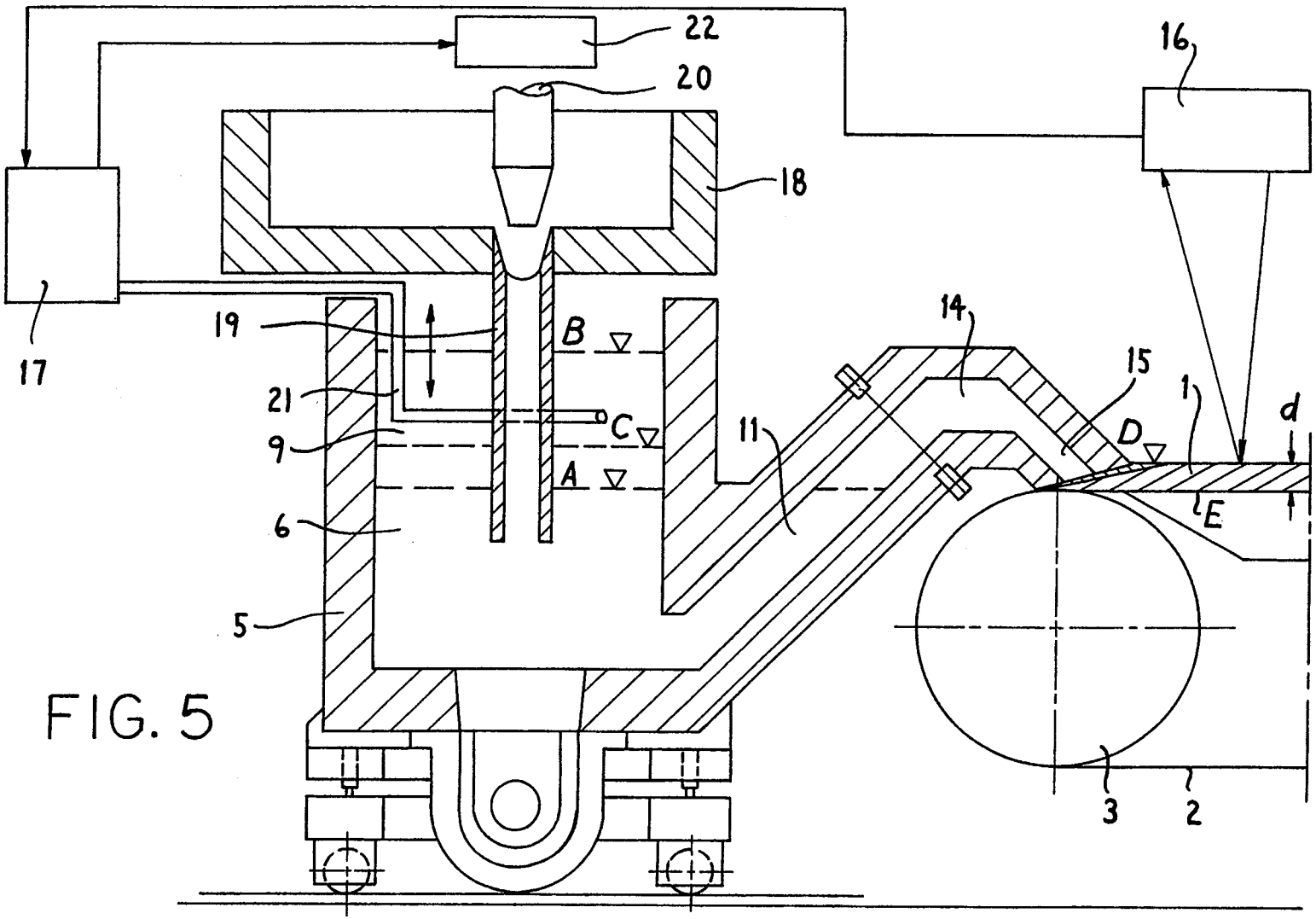
FIG. 5 shows a fourth embodiment of a casting apparatus of the invention.

The casting apparatus according to FIG. 5 operates as follows: A tundish 18 is filled with melt 6 from a melting furnace (not illustrated). The plug 20 is first closed. By opening the plug 20, the melt 6 flows through an immersion tube 19 into the pouring-in chamber 9 of a melt distributor 5 designed as a double chamber. This pouring-in chamber 9 is thereby quickly filled up to the fill level B. It must thereby be guaranteed that the pipette 14 is completely filled with melt 6 in the upper area and the air is driven out. By thereafter throttling the melt supply from the tundish 18, the fill level in the pouring-in chamber 9 drops to the fill level C. This fill level C is in turn chosen such that a predetermined amount of melt outflow at the casting nozzle 15 is adjusted. The further control is done in the manner as described in connection with FIGS. 3 and 4.

It is also possible to cast zinc-containing copper alloys with the described casting apparatus. Underpressure (approximately 0.7 bar) does occur in the pipette 14; however, an equilibrium can occur because Zn vapor is not sucked off through the vacuum pump. Thermodynamic calculations show that also alloys with up to 40% Zn content with 100–150K overheating can be cast without creating Zn vapor bubbles in the pipette 14. Also overheatings adjusted higher due to an error do not interfere with the system since it is self-regulating. In this case, Zn would evaporate from the uppermost point of the pipette 14. A Zn bubble is formed, which, however, disappears again very quickly. Namely, the evaporation heat must be delivered from the melt. Because of the very high evaporation rate of Zn the melt cools off and a portion of the Zn condenses again on the surface of the melt bath and also on the cooler walls of the lining.

Figure 2:
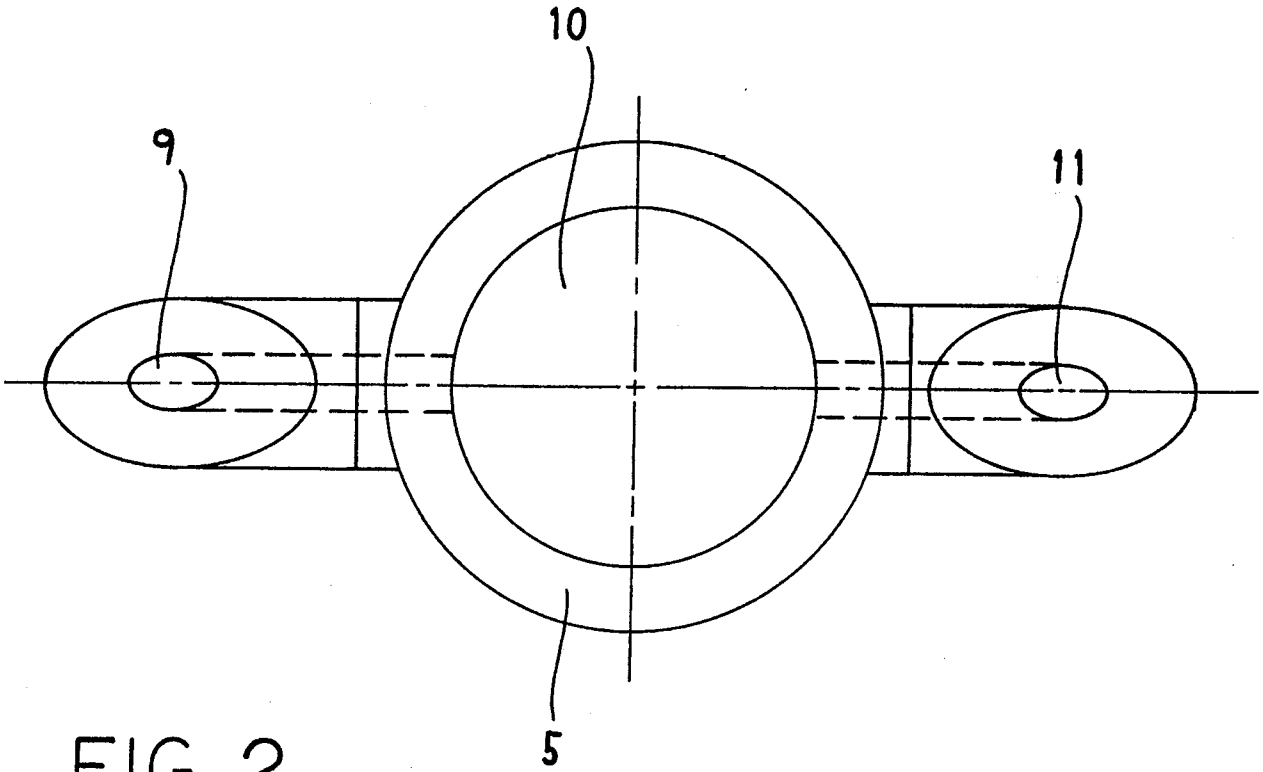
FIG. 2 is a horizontal cross-sectional view of the melt distributor according to FIG. 1 taken along the line II—II.
Figure 6:
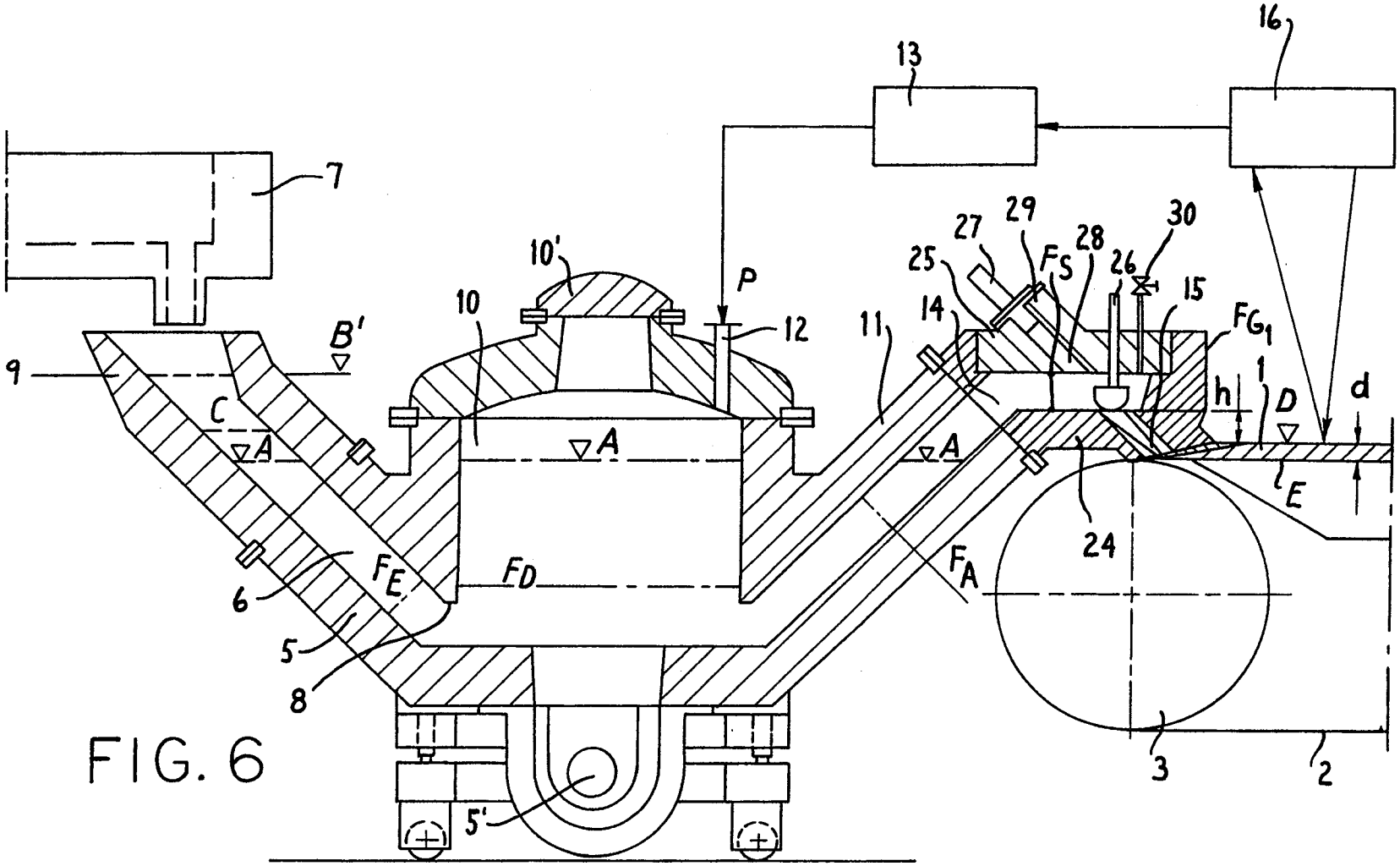
FIG. 6 shows a fifth embodiment of a casting apparatus of the invention.
Figure 7:
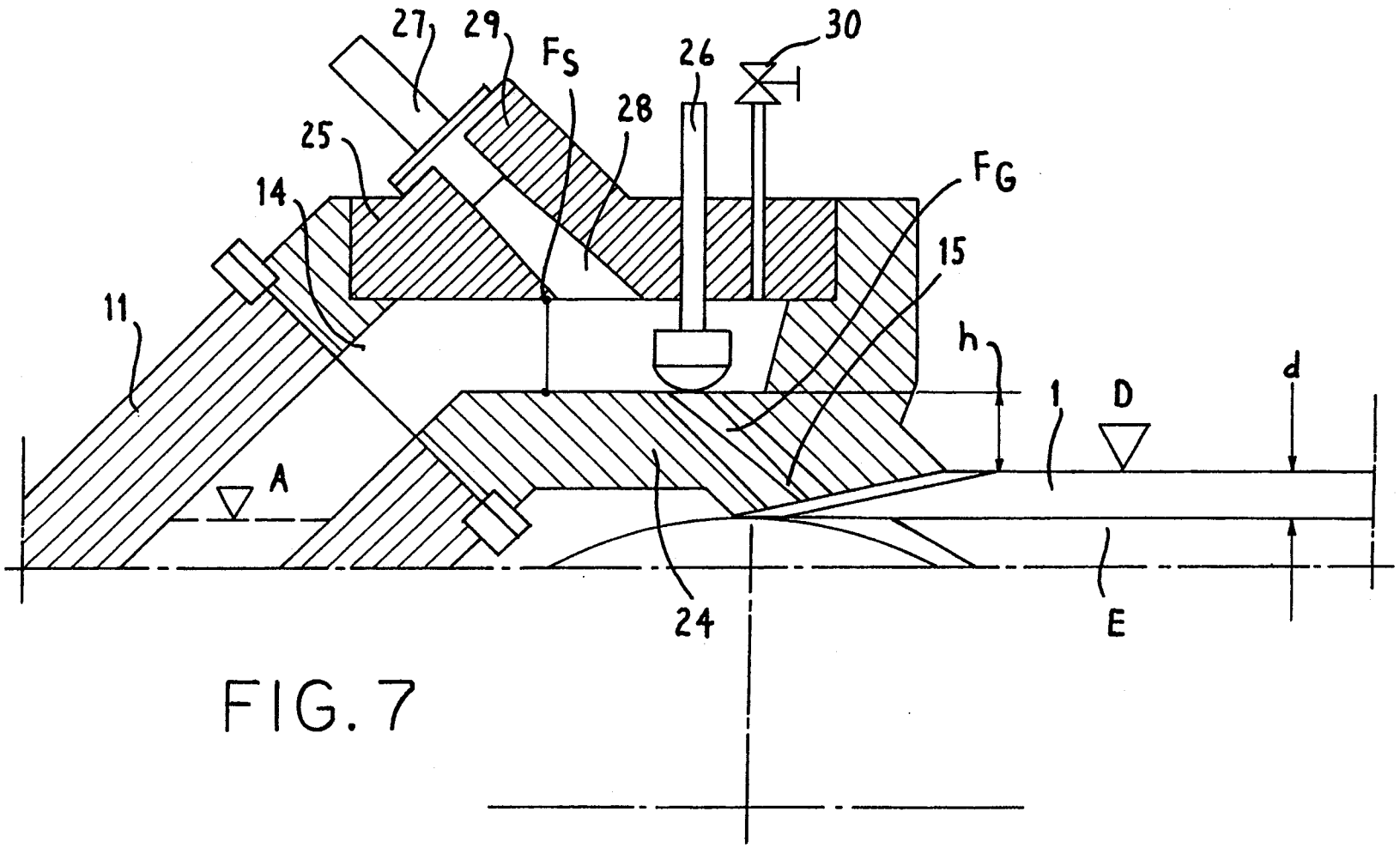
FIG. 7 illustrates in an enlarged scale the pipette with integrated casting nozzle according to FIG. 6.

The casting apparatus according to FIGS. 6 and 7 corresponds in the important parts with those according to FIGS. 1 and 2 (the same parts have the same reference numerals). A pipette 14 designed as a forehearth is in this case connected to the pouring-out chamber 11. A casting nozzle 15 terminating above the plane E of the conveyor belt is embedded in the bottom 24 of said pipette.

In order for the pipette 14 to be accessible for cleaning purposes, it has a removable lid 25. The casting nozzle 15 can be closed off by one (or several) plugs 26, which are guided gastight in the lid 25.

For casting start-up, the apparatus is filled with a metal melt 6 from a (schematically illustrated) tundish 7 through the pouring-in chamber 9. The fill level identified with the letter A and corresponding with the conveyor belt plane E in the present case may thereby not be exceeded.

In order to avoid the freezing of the pipette 14 and casting nozzle 15 during the casting start-up, both parts are preheated. When the plug 26 is lifted, the casting nozzle 15 is heated by means of a gas burner 27, for which an opening 28 or a guideway 29 is provided in or rather on the lid 25. The inlet of the casting nozzle 15 is subsequently closed off again with the plug 26, and the pipette 14 is filled with metal melt 6 by varying the gas pressure in the pressure chamber 10 and is emptied again after a short period of time. This operation is repeated several times. The necessary pressure balance is accomplished by a valve 30 in the lid 25, which valve can also be provided in place of the gas burner 27.

For casting start-up, the entire area of the pipette 14 is filled up to the lid 25 with metal melt 6 (fill level B'). The valve 30 must thereafter be closed. The plug 26 is only partially opened and the metal melt 6 flows into the casting nozzle 15 and forms a "melt pool" on the conveyor belt. An underpressure builds up subsequently in the pipette 14. When the plug 26 is sufficiently opened, the air can rise and can collect under the lid 25 of the pipette 14. After the plug 26 is lifted, the metal level in the pouring-in chamber 9 drops, at a constant pressure in the pressure chamber 10, due to metal melt 6 flowing out. With a dropping metal level in the pouring-in chamber 9, the rate of outflow would drop if this would not be balanced through a continuous lifting of the plug 26 until the desired casting pressure is achieved, namely the fill level C in the pouring-in chamber 9, which is adjusted some millimeters above the level D of the liquid metal on the conveyor belt 2. Only then does a switch to the fine control take place, which fine control adjusts the desired product thickness d through the controllable gas source 13 in response to the strip-thickness measuring device 16. Due to the active pipette principle, the speed of outflow is reduced since the active pressure is determined only by the metallostatic height difference between the fill level C in the pouring-in chamber 9 and level D of the liquid metal. This difference can be adjusted as small as desired, independent of the structurally caused drop height h in the casting nozzle 15.

The underpressure built up in the pipette 14 can moreover be monitored for controlling a safe sequence of operation by means of a measuring device (not illustrated).

Compared with the embodiment according to FIGS. 1 and 2, this modification is less susceptible to gas (air) penetrating through possible leaks. The pipette principle functions also when the entire pipette 14 and even a portion of the casting nozzle 15 is filled with air. This condition can be recognized by means of a pressure measuring device on the pipette 14. In this case either the casting must be interrupted or the underpressure must be newly built up. The latter can happen without any interruption of the casting operation. The plug 26 is closed off so far for this purpose and the pressure in the pressure chamber 10 is at the same time increased and the valve 30 is opened without noticeably changing the through flow. The pipette principle works now only yet between the plug 26 and the outlet of the casting nozzle 15. The pipette 14 can again be filled during this time. After the valve 30 has been closed, the underpressure, as described above, can now be built up and the plug 26 can again be lifted accordingly. Through this periodic switching over from pressure to plug control and vice versa, the casting operation can be maintained as long as desired.

A NUMERICAL EXAMPLE

The described casting apparatus according to FIGS. 1 and 2 is suited for example for the continuous manufacture of a brass strip 1 (CuZn30) with the dimension of 8 mm×400 mm.

The brass melt 6 heated to approximately 1,050° C. is fed with the distributor system according to FIG. 1 to the conveyor belt 2. The cross-sectional surfaces $F_A$, $F_S$, and $F_G$ narrow down in steps in outflow direction. They have the following relationship: $F_A:F_S:F_G=4:2:1$.

The belt 2 is endless and is guided over spaced rollers 3 having a diameter of 1.0 m. A steel belt 2 with a thickness of 1 mm, with a length between the apex points of the rollers 3 of 3,600 mm and with a width of 850 mm is used. The width of the cast tape 1 is predetermined by lateral, stationary borders (not illustrated). The inside width of the casting nozzle 15 corresponds with the distance between the lateral borders. The cross section of the casting nozzle 15 is 10 mm×408 mm.

The melt 6 is cooled with water indirectly through the underside of the conveyor belt 2. The withdrawing speed is 20 m/min. The speed of the melt 6 equals approximately the speed of the conveyor belt 2.

Brass strip 1 with a perfect surface quality and with a low segregation and fine-granular structure can be achieved as the product.

The embodiments of the invention in which an exclusive property or privilege is claimed are defined as follows:

1. In a method for continuous manufacture of a metal strip (1) with approximate final dimensions, in which in an operating condition, a metal melt (6) is fed from a melt distributor (5) through a casting nozzle (15) onto a rotating, cooled conveyor belt (2) and is solidified, and in which in the operating condition, a melt level is controlled in the melt distributor (5) as a function of a desired strip thickness d of the metal strip (1), an improvement comprising initially adjusting a fill level (A), in the melt distributor (5), which fill level corresponds at a maximum with a conveyor belt plane (E), then adjusting a fill level (B) such that the melt (6) completely displaces the air from a region (11, 14) in front of the casting nozzle (15) and from the casting nozzle (15), and in the operating condition, providing a fill level (C) above a level (D) of the liquid metal on the conveyor belt (E) so that the melt (6) flows out of the casting nozzle (15) according to a pipette principle.

2. The method according to claim 1, wherein the fill level (B) is adjusted during casting start-up by a continuous melt supply into the melt distributor (5).

3. In a method for continuous manufacture of a metal strip (1) with near net shape, in which in an operating condition, a metal melt (6) is fed from a melt distributor (5) through a casting nozzle (15) onto a rotating, cooled conveyor belt (2) and is solidified, and in which in the operating condition, a melt level in the melt distributor (5) is controlled as a function of a desired strip thickness d of the metal strip (1), an improvement comprising initially adjusting a fill level (A) in the melt distributor (5) having a pouring-in chamber (9), a gastight pressure chamber (10) and a pouring-out chamber (11), which fill level (A) corresponds at a maximum with a conveyor belt plane (E), then for casting start-up, at least partially filling a pipette (14) to a fill level (B') with an inlet of the casting nozzle (15) closed with respect to the metal (6) and with a pipette value (30) at least partially open, and then partially opening the inlet of the casting nozzle (15) to form a melt pool on the conveyor belt (2) followed by further opening of the inlet of the casting nozzle (15) with the value (30) closed whereby an underpressure is built up in the pipette (14) and air in the casting nozzle (15) is displaced upwardly, and in the operating condition, providing a fill level (C) above a level (D) of the liquid metal on the conveyor belt (E) so that the melt (6) flows out of the casting nozzle (15) according to a pipette principle.

4. The method according to claim 3, wherein the fill level (B') is adjusted during casting start-up by means of excess pressure of an inert gas.

5. The method according to claim 4, wherein the fill level (C) is controlled in the operating condition by means of excess pressure of an inert gas.

6. The method according to claim 4, wherein the fill level (C) is controlled in the operation condition with a continuous melt supply by means of a casting-level control (17).

7. The method according to claim 5, wherein in the operating condition the fill level (C) is controlled at approximately 2–15 mm above the level (D) of the liquid metal.

8. The method according to claim 7, characterized in that the fill level (C) is controlled in dependency of the intended casting speed.

9. The method according to claim 3, wherein the underpressure is built up at a constant pressure in the pressure chamber (10).

10. The method according to claim 3, wherein the underpressure is built up by ventilating the pressure chamber (10).

11. The method according to claim 9, wherein the underpressure built up in the pipette (14).

12. The method according to claim 9, wherein the casting nozzle (15) and the pipette (14) are preheated prior to filling with melt.

13. The method according to claim 12, wherein the casting nozzle (15) is heated up by means of a burner (27) introduced into the pipette (14).

14. The method according to claim 12, wherein the pipette (14) with the valve (30) open and with the inlet of the casting nozzle (15) closed with respect to the metal melt (6), is filled one time or several times with a metal melt (6) by varying the gas pressure in the pressure chamber (10).

15. A casting apparatus comprising: a melt distributor (5) terminating in a casting nozzle (15) above a rotating, cooled conveyor belt (2) and a strip-thickness measuring device (16) connected to a controllable gas source (13), wherein the melt distributor (5) includes a pouring-in chamber (9), a gastight pressure chamber (10) and a pouring-out chamber (11) to which a pipette (14) terminating in the casting nozzle (15) is connected, said casting nozzle having an outlet facing said conveyor belt and disposed in a position to be immersed in melt dispensed onto said conveyor belt during casting, said pouring-in chamber having a cross-sectional surface $F_E$ and said pressure chamber having a cross-sectional surface $F_D$ according to the relationship: $F_E/F_D=1.5$ to 1.16, and wherein the controllable gas source (13) is connected to the pressure chamber (10) to control melt level in the melt distributor above the melt level on the conveyor belt with the outlet of said casting nozzle immersed in melt on said conveyor belt so that melt flows out of the casting nozzle according to a pipette principle during casting.

16. A casting apparatus comprising: a melt distributor (5) terminating in a casting nozzle (15) above a rotating, cooled conveyor belt (2) and a strip-thickness measuring device (16), wherein the melt distributor (5) includes a pouring-in chamber (9) and a pouring-out chamber (11), to which is connected in a pipette (14) terminating in the casting nozzle (15), said casting nozzle having an outlet facing said conveyor belt and disposed in a position to be immersed in melt dispensed onto said conveyor belt during casting, said pouring-out chamber having a cross-sectional surface $F_A$, said pipette having cross-sectional surface $F_S$ and said casting nozzle having cross-sectional surface $F_G$ according to the relationship: $F_A:F_S:F_G=8:4:1$ to $2:1.5:1$, wherein a tundish (18) is disposed above the melt distributor (5) and includes an immersion tube (19) which extends into the pouring-in chamber (9), and wherein the strip-thickness measuring device (16) is connected to a casting-level control (17), a probe (21) of which is disposed above the melt level in the pouring-in chamber (9), said casting-level control being operative to control melt level in the melt distributor above the melt level on the conveyor belt with the outlet of said casting nozzle immersed in melt on said conveyor belt so that melt flows out of the casting nozzle according to a pipette principle during casting.

17. The casting apparatus according to claim 16, wherein the probe (21) is designed elevationally adjustable.

18. A casting apparatus comprising, a melt distributor (5) terminating in a casting nozzle (15) above a rotating, cooled conveyor belt (2) and a strip-thickness measuring device (16) connected to a controllable gas source (13), wherein the melt distributor (5) includes a pouring-in chamber (9), a gastight pressure chamber (10) and a pouring-out chamber (11), to which a pipette (14) terminating int he casting nozzle (15) is connected, said pouring-in chamber having a cross-sectional surface $F_E$ and said pressure chamber having cross-sectional surface $F_D$ according to the relationship: $F_E/F_D=1:5$ to $1:16$, and wherein the controllable gas source (13) is connected to the pressure chamber (10) to control melt level in the melt distributor above the melt level on the conveyor belt so that melt flows out of the casting nozzle according to a pipette principle.

19. A casting apparatus comprising, a melt distributor (5) terminating in a casting nozzle (15) above a rotating, cooled conveyor belt (2) and a strip-thickness measuring device (16), wherein the melt distributor (5) includes a pouring-in chamber (9) and a pouring-out chamber (11), to which is connected a pipette (14) terminating in the casting nozzle (15), said pouring-out chamber having cross-sectional surface $F_A$, said pipette having cross-sectional surface $F_S$, and said casting nozzle having cross-sectional surface $F_G$ according to the relationship: $F_A:F_S:F_G=8:4:1$ to $2:1.5:1$, wherein a tundish (18) is disposed above the melt distributor (5) and includes an immersion tube (19) which extends into the pouring-in chamber (9), and wherein the strip-thickness measuring device (16) is connected to a casting-level control (17), a probe (21) of which is disposed above the melt level in the pouring-in chamber (9), said casting-level control being operative to control melt level in the melt distributor above the melt level on the conveyor belt so that melt flows out of the casting nozzle according to a pipette principle.

* * * * *

UNITED STATES PATENT AND TRADEMARK OFFICE

CERTIFICATE OF CORRECTION

PATENT NO. : 5,355,937
DATED : October 18, 1994
INVENTOR(S) : Hilmar R. MUELLER, et al It is certified that error appears in the above-indentified patent and that said Letters Patent is hereby corrected as shown below:

Column 8, line 67; after "belt" insert ---plane---.

Column 9, line 18; after "metal" insert ---melt---.

line 19; change "value" to ---valve---.

line 23; change "value" to ---valve---.

line 37; change "operation" to ---operating---.

line 54; after "underpressure" insert ---is---.

Signed and Sealed this

Ninth Day of May, 1995

Bruce Lehman

*Attest:*

BRUCE LEHMAN

*Attesting Officer*

*Commissioner of Patents and Trademarks*